US010239196B2

(12) United States Patent
Cheng

(10) Patent No.: US 10,239,196 B2
(45) Date of Patent: Mar. 26, 2019

(54) AIR SUPPLY STRUCTURE OF PNEUMATIC TOOL

(71) Applicant: ANN-CHAIN ENTERPRISE CO., LTD., Changhua, Changhua County (TW)

(72) Inventor: Hui-Cheng Cheng, Changhua (TW)

(73) Assignee: ANN-CHAIN ENTERPRISE CO., LTD., Changhua, Changhua County (TW)

( * ) Notice: Subject to any disclaimer, the term of this patent is extended or adjusted under 35 U.S.C. 154(b) by 531 days.

(21) Appl. No.: 14/942,452

(22) Filed: Nov. 16, 2015

(65) Prior Publication Data

US 2017/0136613 A1 May 18, 2017

(51) Int. Cl.
*B25F 5/00* (2006.01)
*B25F 5/02* (2006.01)

(52) U.S. Cl.
CPC ..... *B25F 5/02* (2013.01)

(58) Field of Classification Search
CPC ..... B25B 21/00; B25F 5/02
USPC ..... 173/104, 218, 168–169
See application file for complete search history.

(56) References Cited

U.S. PATENT DOCUMENTS 3,068,485 A * 12/1962 Lingle ..... B65B 13/345 29/243.56
3,133,288 A * 5/1964 Ohgren ..... B65B 51/04 29/243.56
3,255,525 A * 6/1966 Frenzel ..... B26B 17/02 30/180
3,552,450 A * 1/1971 Plunkett ..... B65B 13/188 140/93.4
3,653,117 A * 4/1972 Wolfberg ..... B65B 13/345 29/243.56
3,797,335 A * 3/1974 Amtsberg ..... B25B 21/00 137/58
5,588,320 A * 12/1996 Lallier ..... B25B 27/146 29/243.5
5,653,140 A * 8/1997 West ..... B25B 27/146 72/407

(Continued)

FOREIGN PATENT DOCUMENTS

TW M457617 7/2013

*Primary Examiner* — Andrew M Tecco
*Assistant Examiner* — Nicholas Igbokwe
(74) *Attorney, Agent, or Firm* — Muncy, Geissler, Olds & Lowe, P.C.

(57) ABSTRACT

An air supply structure of a pneumatic tool includes a housing and a ventilation module. The housing includes an operating portion including an air chamber, a connecting portion including an accommodating space, and a holding portion including an air entering channel and an air exiting channel. The accommodating space is in communication with the air chamber, the air entering channel and the air exiting channel. The ventilation module, disposed in the connecting portion, includes an air inlet in communication with the air entering channel, an air outlet in communication with the air exiting channel, a first air opening in communication with the air chamber, a second air opening in communication with the air chamber, and a ventilation space. Thus, the size of the ventilation space of the ventilation module of individual pneumatic tools is ensured to be uniform to increase the manufacturing yield rate.

6 Claims, 4 Drawing Sheets

(56) References Cited

U.S. PATENT DOCUMENTS

| | | | | |
|---|---|---|---|---|
| 6,719,067 | B2 * | 4/2004 | Taga | B25B 21/02 173/162.2 |
| 7,958,945 | B2 * | 6/2011 | Lu | B25B 21/00 173/168 |
| 2005/0254966 | A1 * | 11/2005 | Liao | B25B 21/00 417/375 |
| 2013/0081838 | A1 * | 4/2013 | Tully | B25F 5/02 173/168 |
| 2013/0081843 | A1 * | 4/2013 | Tully | B25F 5/02 173/221 |

* cited by examiner

AIR SUPPLY STRUCTURE OF PNEUMATIC TOOL

FIELD OF THE INVENTION

The present invention relates to a pneumatic tool, and particularly to an air supply structure of a pneumatic tool.

BACKGROUND OF THE INVENTION

A pneumatic tool is a tool that outputs an operating power through driving a pneumatic motor by compressed air provided by an air compressor. Featuring advantages of having fast motions and strong adaptivity for operability in harsh environments such flammable, explosive, humid and impact-receiving environments, being zero-pollution, as well as having a long life cycle, a simple structure and easy maintenance, pneumatic tools are extensively applied in various fields including modern machinery manufacturing, shipbuilding, vehicle manufacturing, vehicle maintenance, building and decorating, and stone processing.

For example, the Taiwan Patent No. M457617, "Pneumatic Tool", includes a housing, a driving mechanism and an air control mechanism. The housing includes an assembly space and an air entering channel in communication with the assembly space. The driving mechanism, installed in the assembly space of the housing, includes a cylinder block, and a forward rotation channel and a reverse rotation channel in communication with the cylinder. The air control mechanism includes an air control valve installed in the air entering channel and connected correspondingly to the cylinder block, and a control lever seat that drives the air control valve to rotate along a rotation center. The air control valve includes an air control channel that rotates and corresponds to the forward rotation channel and the reverse rotation channel of the cylinder block.

However, when the housing of the pneumatic tool is manufactured, the air control channel is manufactured through a sand core mold. More specifically, during the manufacturing process of the housing, sand is first buried at a position of the air control channel, and the sand buried at the position of the air control channel is then removed when the housing has been manufactured to further form the air control channel. During the manufacturing process of the housing, a collapse is likely caused due to an inappropriate amount of sand buried or an inadequate strength of the sand core. As a result, defects including a non-uniform size of the air control channel or the failure of connecting to the cylinder block may be produced, leading to a lowered yield rate. Therefore, it is a goal of manufacturers of the technical field to provide a solution that reduces defects of the air control channel.

SUMMARY OF THE INVENTION

The primary object of the present invention is to solve issues of defects caused by an inappropriate amount of sand buried and the lowered yield rate.

To achieve the above object, the present invention provides an air supply structure of a pneumatic tool. The air supply structure of a pneumatic tool includes a housing and a ventilation module. The housing includes an operating portion, a connecting portion and a holding portion. The operating portion includes an air chamber. The connecting portion includes an accommodating space. The holding portion includes an air entering channel and an air exiting channel. The accommodating space is in communication with the air chamber, the air entering channel and the air exiting channel. The ventilation module, disposed in the accommodating space of the connecting portion, includes an air inlet in communication with the air entering channel, an air outlet in communication with the air exiting channel, a first air opening in communication with the air chamber, a second air opening in communication with the air chamber, and a ventilation space in communication with the air inlet, the air outlet, the first air opening and the second air opening.

In conclusion, in the present invention, the ventilation module is disposed in the connecting portion to replace the conventional manufacturing method of a sand core. Thus, the ventilation module is ensured to have an appropriate size and to be in communication with the air entering channel, the air exiting channel and the air chamber, thereby increasing the yield rate.

DETAILED DESCRIPTION OF THE PREFERRED EMBODIMENTS

Figure 1:
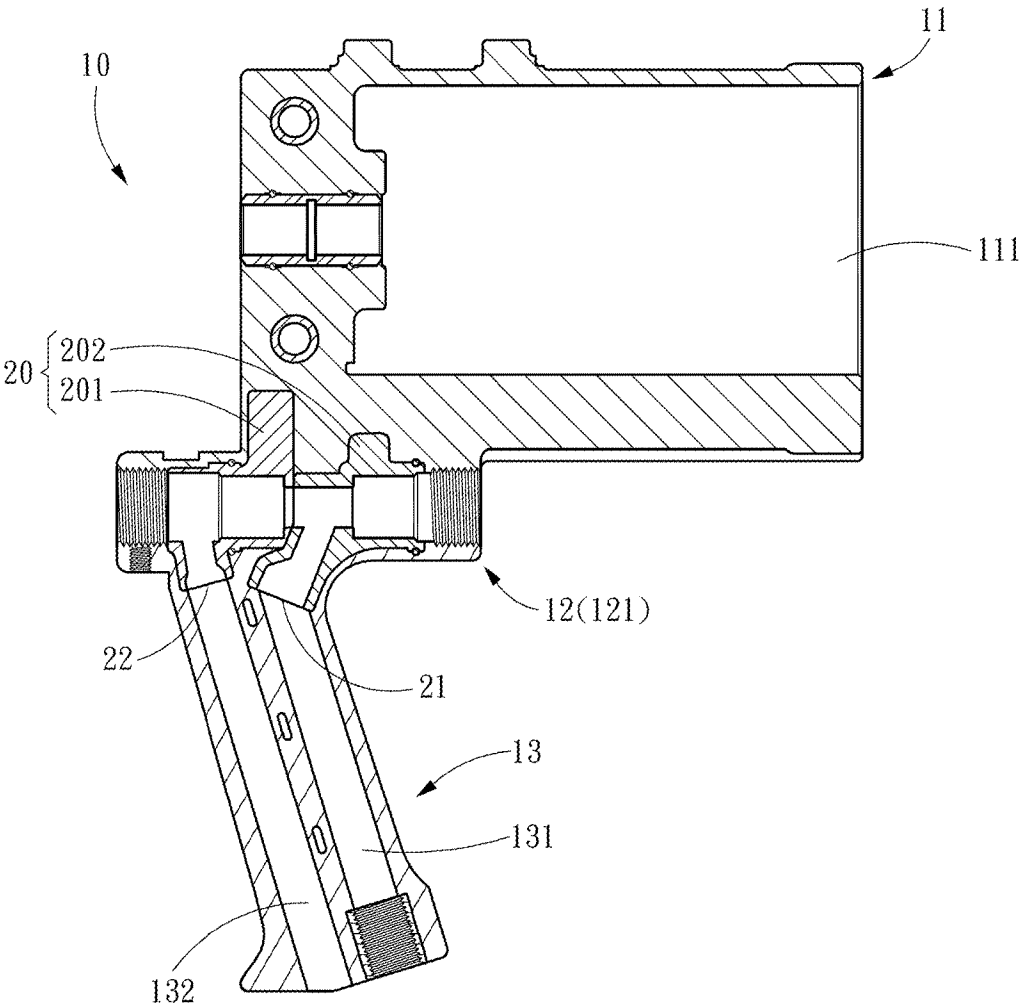
FIG. 1 is a schematic diagram of an air supply structure according to a preferred embodiment of the present invention.
Figure 2:
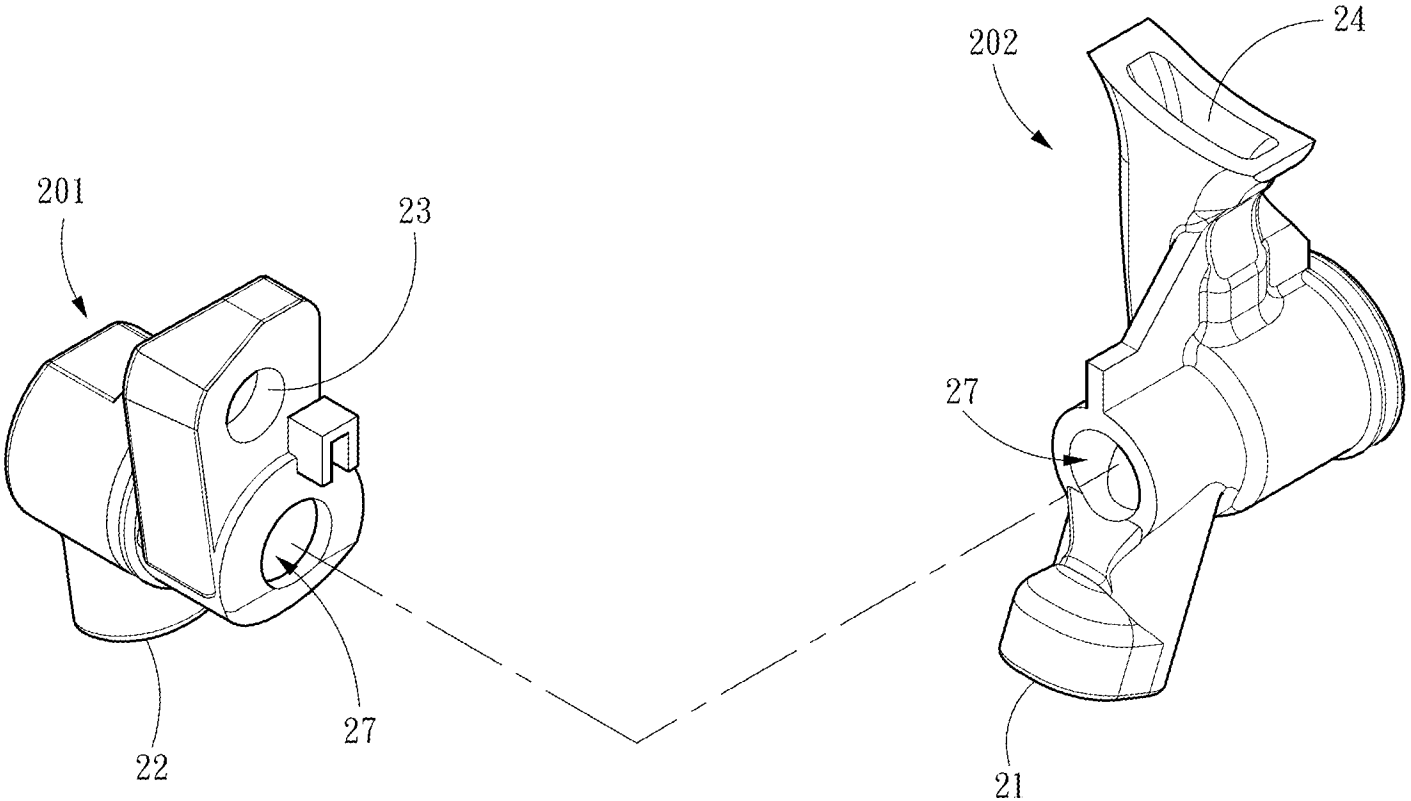
FIG. 2 is a schematic diagram of a ventilation module according to a preferred embodiment of the present invention.

Referring to FIG. 1 and FIG. 2, the present invention provides an air supply structure of a pneumatic tool. The air supply structure of a pneumatic tool includes a housing 10 and a ventilation module 20. The housing 10 includes an operating portion 11, a connecting portion 12 and a holding portion 13. The operating portion 11 includes an air chamber 111. The connecting portion 12 includes an accommodating space 121. The holding portion 13 includes an air entering channel 131 and an air exiting channel 132. The accommodating space 121 is in communication with the air chamber 111, the air entering channel 131 and the air exiting channel 132. The material of the housing 10 is plastic steel, which is a composite material formed by fiber glass and epoxy. Compared to a metal material used for casting, plastic steel is lighter in weight for a user to more easily hand-hold and operate for an extended period of time, and features advantages of being hard, embrittlement resistant, moisture resistant, abrasion resistant, deformation resistant and acid alkali resistant. The ventilation module 20, disposed in the connecting portion 12, includes an air inlet 21 in communication with the air entering channel 131, an air outlet 22 in communication with the air exiting channel 132, a first air opening 23 in communication with the air chamber 111, a second air opening 24 in communication with the air chamber 111, and an ventilation space 27 in communication with the air inlet 21, the air outlet 22, the first air opening 23 and the second air opening 24.

In a manufacturing process of the present invention, the ventilation module 20 is first manufactured. After having manufactured the ventilation module 20, the ventilation module 20 is placed into a mold of the housing 10, and plastic steel is injected therein, such that the ventilation module 20 is installed and connected in the accommodating space 121 of the connecting portion 12. The plastic steel is then cured to complete the manufacturing process. The formation method of the plastic steel is injection molding, and replaces a conventional casting method that requires a tremendous amount of human power for injecting a high-temperature liquid-state metal into a mold and obtains a finished product by knocking out an external mold. Thus, the formation method of the present invention, compared to the conventional casting method, reduces the waste in human power and damages caused by accidentally coming into contact with the high-temperature liquid-state metal. By disposing the ventilation module 20 in the connecting portion 12, not only the size of the ventilation space 27 of the ventilation module 20 but also the communication relationship between the ventilation module 20 and the air entering channel 131, the air exiting channel 132 and the air chamber 111 is ensured.

In the embodiment, the ventilation module 20 includes a first assembly member 201, and a second assembly member 202 connected to the first assembly member 201. The first assembly member 201 includes the air outlet 22 and the first air opening 23. The second assembly member 202 includes the air inlet 21 and the second air opening 24. By dividing the ventilation module 20 into the separately manufactured first assembly member 201 and second assembly member 202, the manufacturing complexity of the ventilation module 20 can be reduced to increase the yield rate.

Figure 3A:
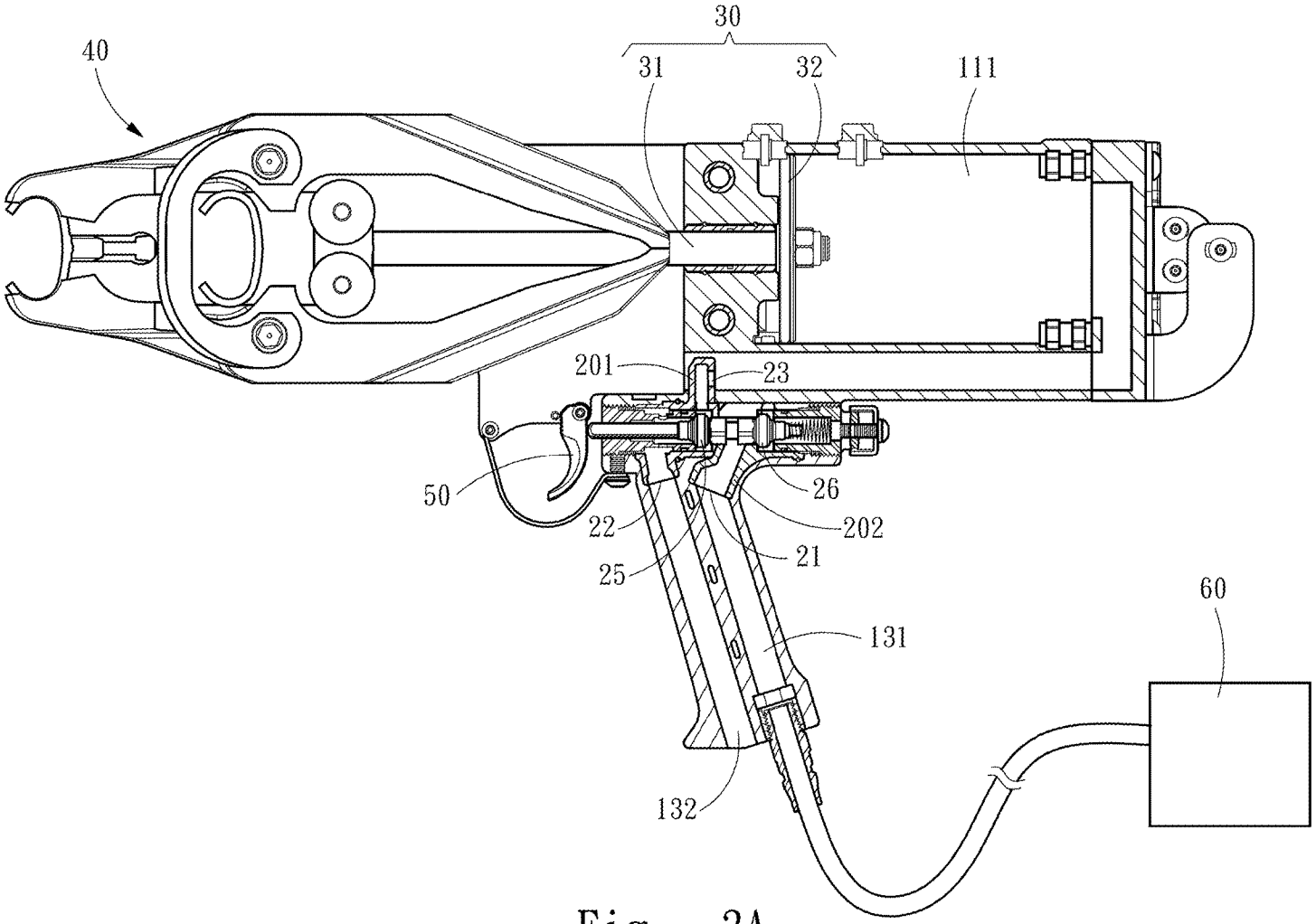
FIG. 3A to 3B are schematic diagrams of operations of an application according to a preferred embodiment of the present invention.
Figure 3B:
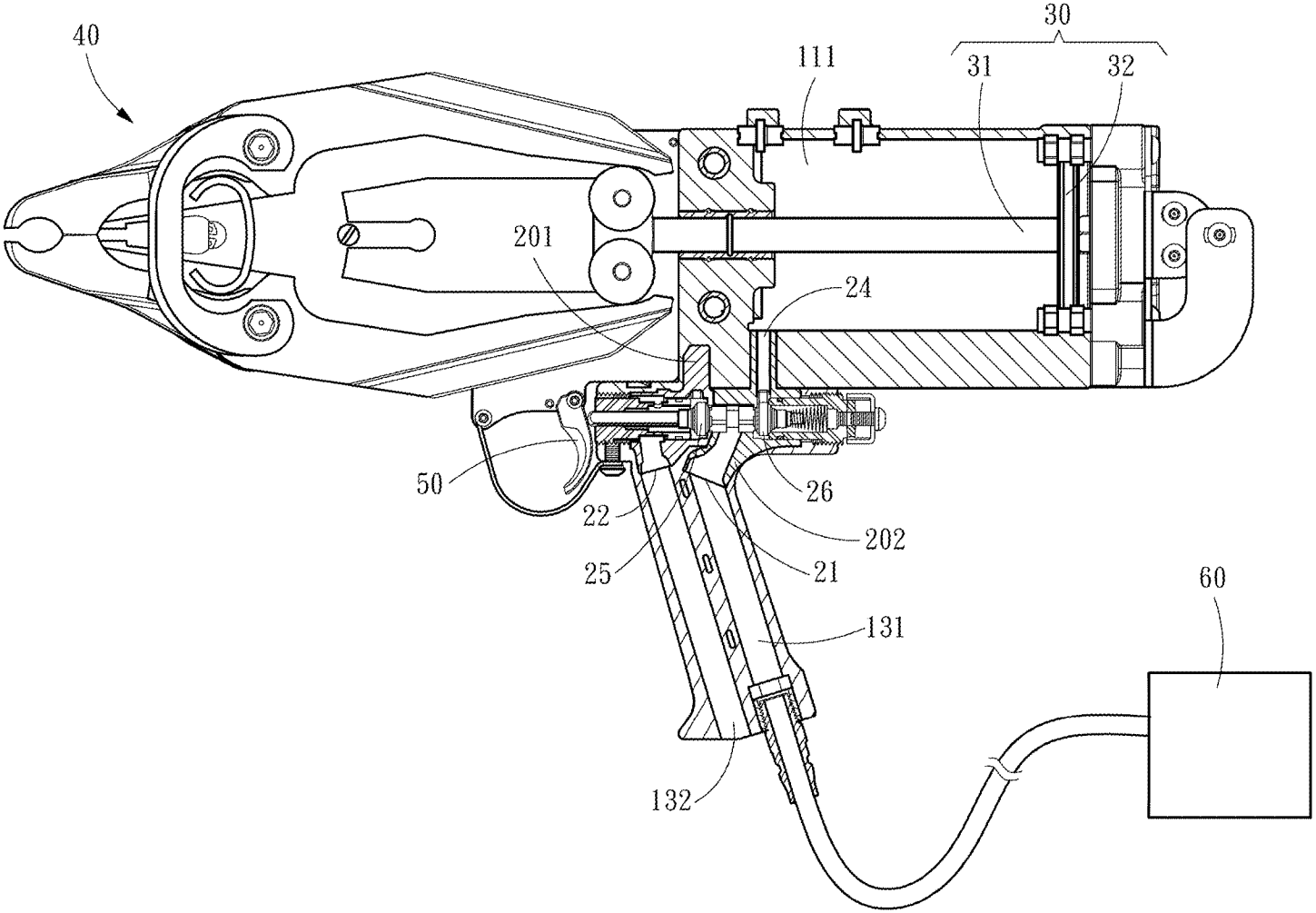

Referring to FIG. 3A and FIG. 3B, an application of the present invention further includes a piston 30, a first air valve 25, a second air valve 26, a working element 40, a pressing member 50 and an air pressure providing member 60. The air pressure providing member 60 is in communication with the air entering channel 131 and away from the air inlet 21, and provides an air pressure. The piston 30 is disposed in the operating portion 11, and includes a central axis 31 and a piston sheet 32 that drives the central axis 31. The diameter of the piston sheet 32 is equal to that of the air chamber 111. The first air valve 25 and the second air valve 26 are disposed in the ventilation module 20. In a first state, the first air valve 25 is open and the second air valve 26 is closed, such that the first air opening 23 is in communication with the air inlet 21 and the air chamber 111, and the piston 30 is located at a forward position. In a second state, the first air valve 25 is closed and the second air valve 26 is open, such that the second air opening 24 is in communication with the air inlet 21 and the air chamber 111, and the piston 30 is located at a withdrawn position.

As shown in FIG. 3A, the pressing member 50 is connected to the first air valve 25 and the second air valve 26. When the pressing member 50 is at a lax position, the first air valve 25 and the second air valve 26 form the first state. Further, air enters the ventilation module 20 via the air inlet 21 and enters the air chamber 111 via the first air opening 23, such that the piston 30 is located at the forward position. As shown in FIG. 3B, when the pressing member 50 is located at a pressing position, the first air valve 25 and the second air valve 26 form the second state. Further, air enters the ventilation module 20 via the air inlet 21 and enters the air chamber 111 via the second air opening 24, and the air pressure of the air then thrusts the piston 30 back to the withdrawn position.

The working element 40 is connected to the central axis 31. As the pressing member 50 alternately switches between the lax position and the pressing position and the piston 30 moves between the forward position and the withdrawn position, the working element 40 is driven to work.

In conclusion, the present invention provides following features.

1. The ventilation module is first manufactured and then placed in the connecting portion. Therefore, not only the size of the ventilation space of the ventilation module, but also the communication relationship between the ventilation module and the air entering channel, the air exiting channel and the air chamber can be ensured.

2. By separately manufacturing the first assembly member and the second assembly member of the ventilation module, the manufacturing complexity of the ventilation module is lowered to hence increase the yield rate.

3. The material of the housing is plastic steel. Compared to a metal material used for conventional casting, plastic steel is lighter in weight for a user to more easily hand-hold and operate for an extended period of time, and features advantages of being hard, embrittlement resistant, moisture resistant, abrasion resistant, deformation resistant and acid alkali resistant.

4. The formation method of the housing is injection molding. Compared to the conventional casting method that requires a tremendous amount of human power for injecting a high-temperature liquid-state metal into a mold and obtains a finished product by knocking out an external mold, the present invention reduces the waste in human power and damages caused by accidentally coming into contact with the high-temperature liquid-state metal.

What is claimed is:

1. An air supply structure of a pneumatic tool, comprising:

a housing, comprising an operating portion, a connecting portion and a holding portion, the operating portion comprising an air chamber, the holding portion comprising an air entering channel and an air exiting channel, the connecting portion being in communication with the air chamber, the air entering channel and the air exiting channel;

a ventilation module, disposed in the connecting portion, the ventilation module separately manufactured into a first assembly member and a second assembly member connected to the first assembly member, and the ventilation module comprising a ventilation space between the first assembly member and the second assembly member, wherein the first assembly member comprises an air outlet and a first air opening, and the second assembly member comprises an air inlet and a second air opening, and the ventilation space is communicated with the air inlet, the air outlet, the first air opening and the second air opening;

a piston, disposed in the operating portion;

a first air valve, disposed in the ventilation module; and a second air valve, disposed in the ventilation module;

wherein in a first state, the first air valve is open and the second air valve is closed, such that the first air opening communication with the air inlet and the air chamber, and the piston is located at a forward position;

wherein in a second state, the first air valve is closed and the second air valve is open, such that the second air opening is in communication with the air inlet and the air chamber, and the piston is located at a withdrawn position.

2. The air supply structure of a pneumatic tool of claim 1, wherein the piston comprises a central axis, and a piston sheet that drives the central axis and has a diameter equal to that of the air chamber.

3. The air supply structure of a pneumatic tool of claim 1, further comprising:

a working element, connected to a central axis, pushed by the piston moving between the forward position and the withdrawn position.

4. The air supply structure of a pneumatic tool of claim 1, further comprising:

a pressing member, connected between the first air valve and the second air valve;

wherein, when the pressing member is at a lax position, the first air valve and the second air valve form the first state; when the pressing member is at a pressing position, the first air valve and the second air valve form the second state.

5. The air supply structure of a pneumatic tool of claim 1, further comprising an air pressure providing member that is in communication with the air entering channel and away from the air inlet.

6. The air supply structure of a pneumatic tool of claim 1, wherein a material of the housing is plastic steel.

* * * * *